US005488458A

United States Patent [19]

Benedict et al.

[11] Patent Number: 5,488,458

[45] Date of Patent: Jan. 30, 1996

[54] DUPLEX PRINTING INTEGRITY SYSTEM

[75] Inventors: Lawrence R. Benedict, Rushville; Gaith O. Zayed, Rochester, both of N.Y.

[73] Assignee: Xerox Corporation, Stamford, Conn.

[21] Appl. No.: 438,139

[22] Filed: May 8, 1995

[51] Int. Cl.[6] ..... G03G 15/00

[52] U.S. Cl. ..... 355/206; 355/319; 358/296

[58] Field of Search ..... 355/206, 319, 355/316; 395/101; 358/296, 474–498, 526; 101/181

[56] References Cited

U.S. PATENT DOCUMENTS

| | | | |
|---|---|---|---|
| 4,348,101 | 9/1982 | Schonfeld et al. | 355/319 |
| 4,453,841 | 6/1984 | Bobick et al. | 347/16 |
| 4,855,790 | 8/1989 | Suzuki | 355/319 X |
| 4,932,320 | 6/1990 | Brunetti et al. | 101/181 |
| 5,337,135 | 8/1994 | Malachowski et al. | 355/319 |
| 5,410,419 | 4/1995 | Muramastsu et al. | 358/475 X |

*Primary Examiner*—Joan H. Pendegrass
*Assistant Examiner*—Sophia S. Chen

[57] ABSTRACT

In a duplex printing integrity system for insuring that correctly matching pages are being printed by a duplex printer on the opposing first and second sides of the sheets, the duplex printer having a duplex loop path circulating sheets printed on one side back to be printed on their opposite side and an output path for feeding out the duplex sheets after they have been printed on both sides; the printer is operable to selectively print a few small, simple solid marks spaced along the sheets, specifically printing a sequence of sheets with correspondingly spaced and parallel print marks, with different spacings of the marks on the sheets for different sheets in the duplex loop. A first optical sensor in the output path line scan the first sides, and an adjacent second optical sensor scanning the second sides, and a comparison circuit continuously compares the sensor output signals to provide a duplex printing error signal when the first and second optical sensors provide different output signals at different times due to a duplex document sheet passing the sensors which is not printed on opposing sides with correspondingly spaced print marks. A time delay circuit may be connected between at least one of the first and second sensors and the comparison circuit to allow the sensors and/or the pattern of print marks to be offset from one another.

8 Claims, 4 Drawing Sheets

DUPLEX PRINTING INTEGRITY SYSTEM

Figure 1:
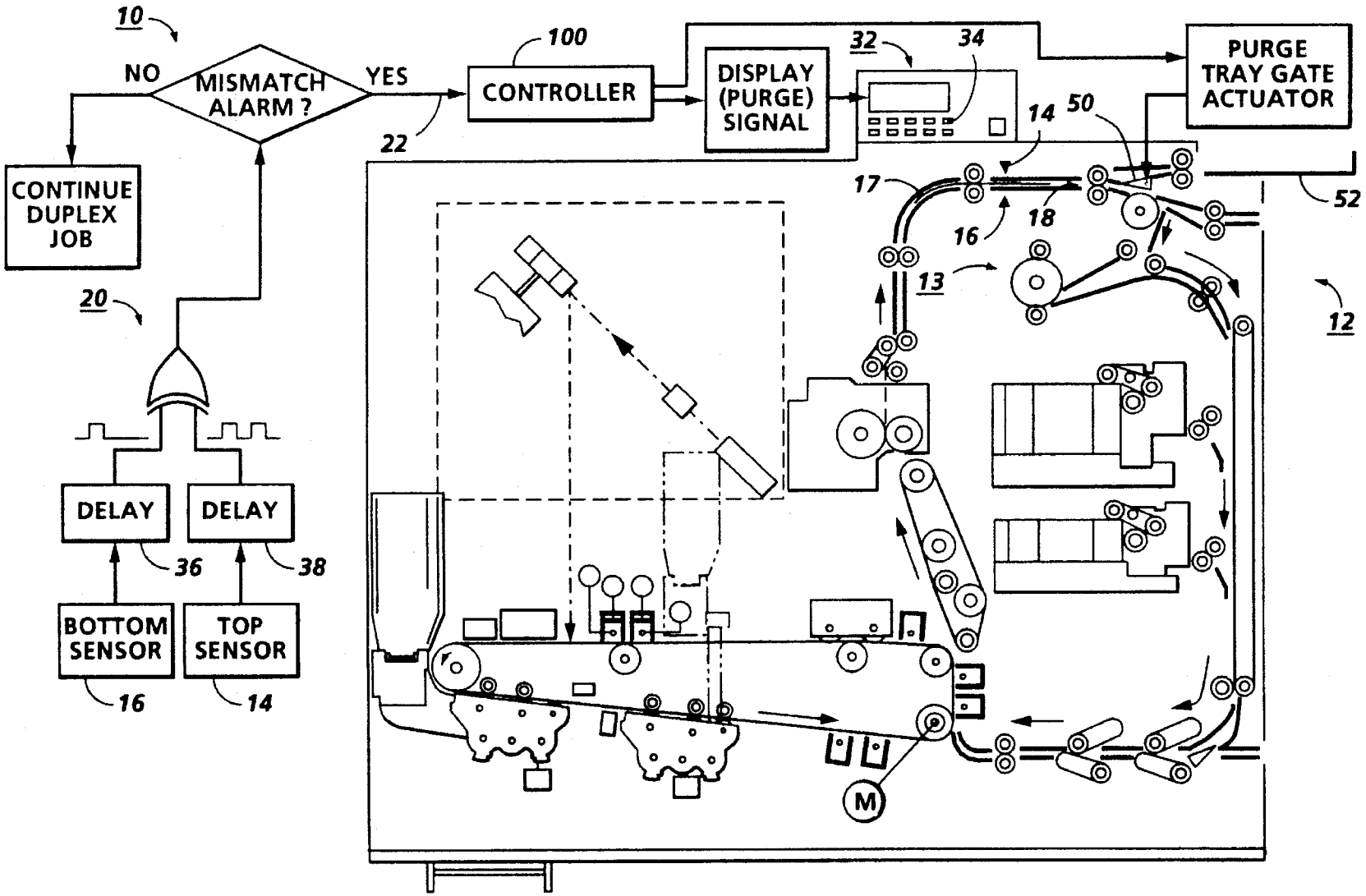
Figure 2:
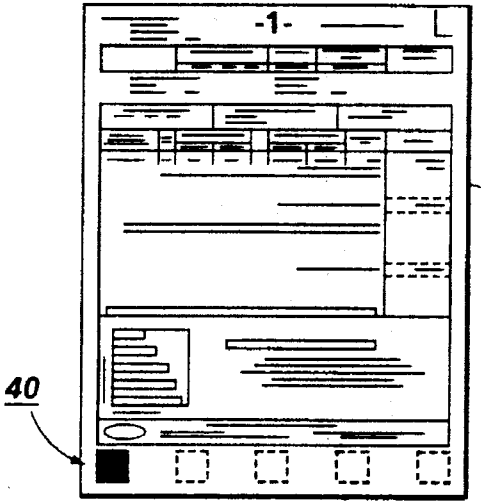
Figure 3:
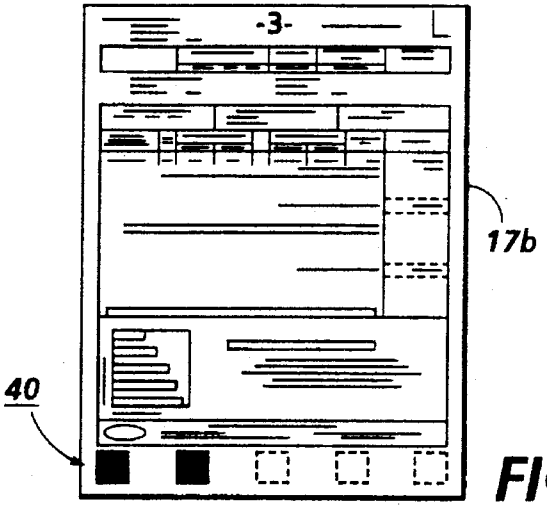

Disclosed is an improved, simple and low cost system for providing duplex printing integrity.

Relatively complex duplex printing integrity systems are known to detect, signal and stop printing in response to detected errors in duplex printing, as further noted below. Specifically, to detect that the page images printed on the opposite sides of a sheet are not in the correct order and relationship, or otherwise not properly related to one another. Otherwise the pages on opposite sides of sheets could erroneously not even be in the same job and/or for the same client or customer, and/or be missing, or erroneously intermixed pages of a plural page print job.

As shown from the example disclosed herein, the present inventors have discovered that a duplex printing integrity system can be greatly simplified and made independent of other system errors by not requiring any connection or coordination with the printer controller microprocessor or other printing page sequence information for its page error detection function. It can, as disclosed, instead rely on its own simple and self contained electronics together with very simple and relatively uncritical small spaced markings printed on margins of both sides of the duplex sheet being printed, which simple spaced marks can be read by simple line sensors optically scanning opposite sides of the sheet anywhere appropriate along the output path of the printer to detect and signal a duplexing error. That duplexing error signal information can then be used to display an operator warning and/or provide a signal for a job recovery mode, and/or an automatic purge of at least the erroneously printed sheets, etc., and need not necessarily require stoppage of the printer.

This new duplex printing integrity system can be particularly valuable for duplex printing of personalized security documents, as well as customer invoices and other plural page duplex printing error sensitive material. For example, currently in the banking industry, many customers require a 100% guarantee of no image mixups on certain printed documents. Yet unavoidably occasionally duplex copiers or duplex electronic printers get pages out of order during duplex printing. i.e., sheets getting out of sequence in the duplex path. For example, by one sheet "diving" or going under rather than over another sheet in a duplex tray or path, or sheets getting out of order after an operator paper path jam clearance. There is currently available a commercial bar code scanning unit which some customers are buying for their printing machines, and using with page identifying bar codes printed on the sheets (see also below). It costs these customer about $45,000 per machine, yet these customers are willing to pay even this high price for a duplex printing integrity check. A printed bar code system may also require trimming of the lower half of the sheet if the customer finds the bar code marks offensive, since standard bar codes are relatively large area and highly visible patterns of numerous fine and closely spaced bars. As is well known, bar codes do not read or scan properly if they are not accurately printed, i.e., they are quite critical in the printing of the bar dimensions, sharpness, and spacings.

The present system can provide such a duplex printing integrity function much more simply, with less critically, and at vastly less cost. No critical bar code printing is required, no new, extra or special ink or toner need be used, such as UV (ultraviolet) invisible ink or toner, nor is any additional printing station or printing apparatus required to be added to existing printers. Simple electronics with little or no added software can be used. It can be easily added to existing duplex printers, even in the field.

Figure 4:
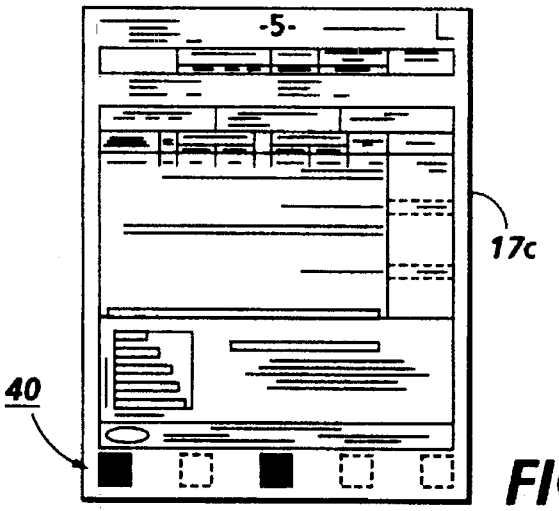
Figure 5:
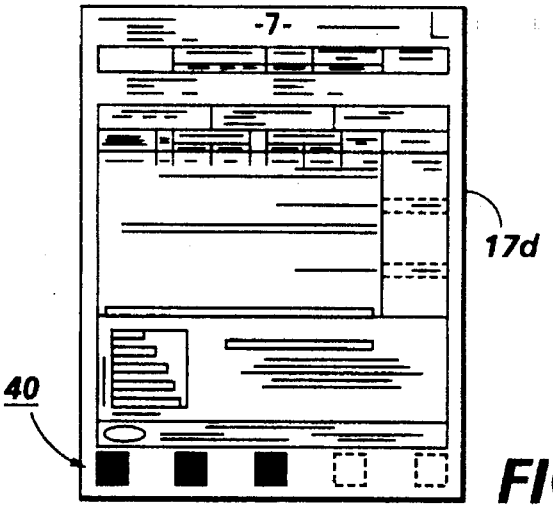
Figure 6:
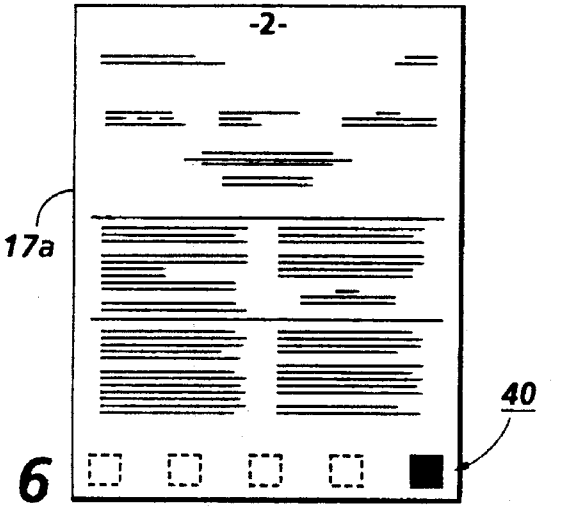
Figure 7:
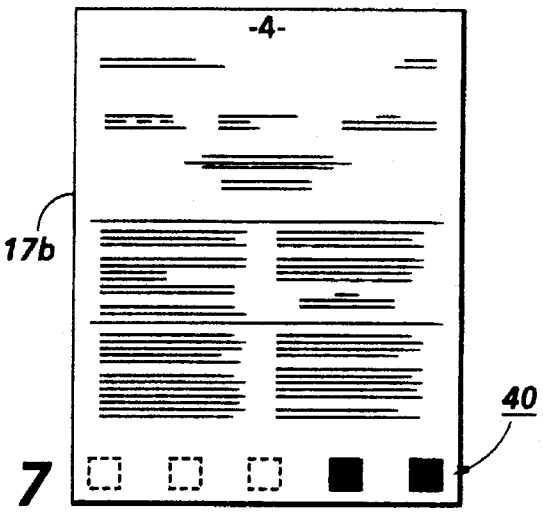
Figure 8:
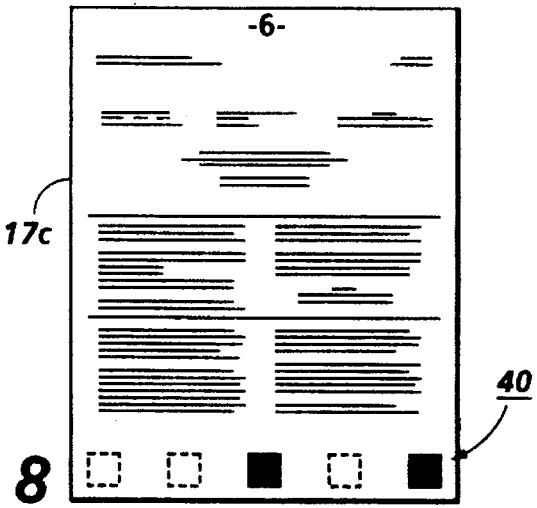
Figure 9:
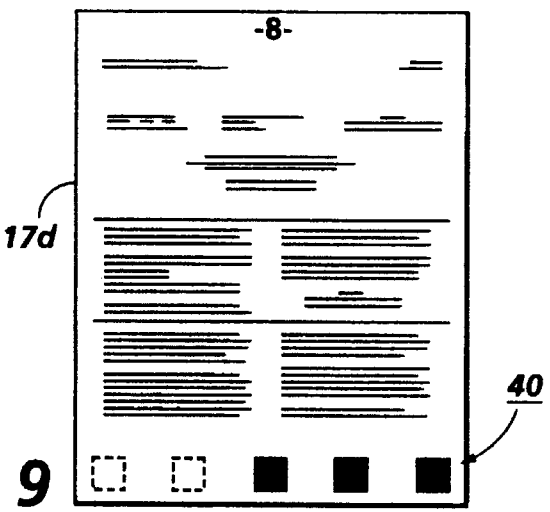

A prior art reference of particular interest noted on electronic duplex printing page order confirmation is U.S. Pat. No. 4,348,101 issued Sep. 7, 1982 to Schonfeid, et al, by Sperry Corporation. The paragraph thereof bridging Cols. 10–11, the Abstract lines 15–18, the FIG. 1 upper sheet surface sensor 132, 134, and FIG. 4, in particular, generally suggest a pattern of short thick and thin dark lines on one edge on the first side which is printed for coded pagination, which printed coding is optically detected on only that same one (top) side just before the second (opposite) side of a sheet is to be printed to detect which sheet is being duplexed, and to provide a printing termination control signal if the wrong sheet is being duplex printed. However, as generally indicated there, but not clearly taught, and as further discussed below in contrast to the present system, software coordination with variable page printing information in a microcontroller 502 of the printer is required for this U.S. Pat. No. 4,348,101 type system.

By way of general background on duplex printing systems, particularly for laser or other electronic printers, in addition to said U.S. Pat. No. 4,348,101 above, various such systems with duplexing paths and their operations are well know and thus need not be described herein. For example, Xerox Corporation U.S. Pat. Nos. 5,337,135; 5,159,395; 5,095,342; 5,014,977; 4,941,023; 4,918,490; 4,708,462; and other art cited therein. Another duplex printing system, for ink jet printing, is shown in U.S. Pat. No. 4,453,841 to Bobick et al by the Mead Corporation.

A specific feature of the specific embodiment disclosed herein is to provide a duplex printing integrity system for insuring that correctly matching pages are being printed by a duplex printer on the opposing first and second sides of the printed duplex document sheets, wherein said duplex printer has a duplex loop path for circulating sheets printed on one side back to be printed on their opposite side, and an output path for feeding out the duplex document sheets after they have been printed on both sides, said printer being operable to selectively print marks on selectable areas of said duplex document sheets, the improvement comprising: a first optical sensor positioned in said output path of said duplex printer positioned to line scan said first sides of said printed duplex document sheets as said printed duplex document sheets are fed past said first optical sensor; a second optical sensor positioned in said output path of said duplex printer positioned to line scan said second sides of said printed duplex document sheets as said printed duplex document sheets are fed past said first optical sensor; and said opposing first and second sides of a sequence of respective said printed duplex document sheets being printed with correspondingly spaced and parallel said print marks, but with different spacings of said marks on said sheets for different said sheets in said sequence.

Further specific features of the specific embodiment disclosed herein, individually or in combination, include those wherein the duplex printing integrity system includes a comparison circuit, and wherein said first and second optical sensors provide respective output signals which are electronically connected to said comparison circuit, to provide a duplex printing error signal when said first and second optical sensors provide different said output signals at different times to said comparison circuit responsive to a duplex document sheet passing said sensors which is not so printed on said opposing sides with said correspondingly spaced print marks; and/or wherein a time delay circuit is connected between at least one of said first and second optical sensors and said comparison circuit to allow said first and second optical sensors and said print marks to be offset from one another; and/or wherein said print marks are simple small solid areas; and/or wherein said print marks are all positioned in one edge margin of said duplex document sheets; and/or wherein said print marks are not more than three simple discrete small solid areas variably linearly positioned substantially spaced part from one another and printed only in an otherwise substantially unprinted top or bottom edge margin of each of said duplex document sheets; and/or wherein said sequence corresponds to the number of said sheets in said duplex loop path of said printer at any one time; and/or wherein said number of sheets with differently spaced marks at one time need not be greater than 7, nor the number of marks per sheet side greater than two.

The various printing systems with which the presently disclosed apparatus may be used may be readily operated and controlled with conventional control systems. It is well known and commonplace to program and execute imaging, printing, document, and/or paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional together with general knowledge in the software and computer arts. That can include object oriented software development environments, such as C++. Alternatively, the disclosed system or method may be implemented partially or fully in hardware, using standard logic circuits or a single chip using VLSI designs.

In a modern printing system, especially in a networked office environment, various of the control and/or software functions of the printer may be done in the network system print server or controller rather than in the printer unit per se. Likewise, as is also known and taught, user interactions, control and status displays with, for, and from the printing apparatus from the terminals or PC's of individual networked users. Control signals and terminal display interactive interfaces between user remote terminals and electronic printers in general are known and commercially available and need not be described in detail herein. Examples of some recent patents relating to network environments of plural remote terminal shared users of networked printers include Xerox Corporation U.S Pat. Nos. 4,453,128; 5,170,340; 5,226,112; 5,243,518; 5,287,194; EPO 0529818A3 pub. Mar. 3, 1993; and GB 2198566A pub. 15 Jun. 1988. Some patents on this subject by others include U.S. Pat. Nos. 4,623,244; 4,651,278; 4,760,458; 4,821,107; 4,903,229; 4,953,080; 5,113,355; 5,113,494; 5,181,162; 5,220,674; 5,247,670 and 5,371,837. Further by way of background, some of the following Xerox Corporation U.S. patents also include examples of networked systems with printers: U.S. Pat. Nos. 5,153,577; 5,113,517; 5,072,412; 5,065,347; 5,008,853; 4,947,345; 4,939,507; 4,937,036; 4,920,481; 4,914,586; 4,899,136; 4,453,128; 4,063,220; 4,099,024; 3,958,088; 3,920,895; and 3,597,071. Some of these patents also disclose multifunctional machines, such as digital printer/scanner/facsimile/copier machines, and their controls.

Some other network systems related publications include "Xerox Office Systems Technology" "... Xerox 8000 Series Products: Workstations, Services, Ethernet, and Software Development" ©1982, 1984 by Xerox Corporation, OSD-R8203A, Ed. T. Linden and E. Harslem, with a "Table of Contents" citing its numerous prior publications sources, and an Abstract noting the April 1981 announcement of "the 8110 Star Informations System, a new personal computer . . . "; "Xerox System Integration Standard Printing Protocol XSIS 118404", April 1984; "Xerox Integrated Production Publishers Solutions: . . . " Booklet No. "610P50807" "11/85"; "Printing Protocol-Xerox System Integration Standard" ©1990 by Xerox Corporation, XNSS 119005 May 1990 ; "Xerox Network Systems Architecture", "General Information Manual", XNSG 068504 April 1985, with an extensive annotated bibliography, ©1985 by Xerox Corporation; "Interpress™: The Source Book", Simon & Schuster, Inc., New York, N.Y., 1988, by Harrington, S. J. and Buckley, R. R.; Adobe Systems Incorporated "PostScript® Language Reference Manual", Addison-Wesley Co., 1990; "Mastering Novell® Netware®", 1990, SYBEX, Inc., Alameda, Calif., by Cheryl E. Currid and Craig A. Gillett; "Palladium Print System" ©MIT 1984, et sec; "Athena85" "Computing in Higher Education: The Athena Experience", E. Balkovich, et al, Communications of the ACM, 28(11) pp. 1214–1224, November, 1985; and "Apollo87" "The Network Computing Architecture and System: An Environment for Developing Distributed Applications", T. H. Dineen, et al, Usenix Conference Proceedings, June 1987.

Noted re commercial network systems with printers and software therefore is the 1992 Xerox Corporation "Network Publisher" version of the 1990 "DocuTech®" publishing system, including the "Network Server" to customer's Novell® 3.11 networks, supporting various different network protocols and "Ethernet™"; and the Interpress Electronic Printing Standard, Version 3.0, Xerox System Integration Standard XNSS 048601 (January 1986). Also, the much earlier Xerox Corporation "9700 Electronic printing System"; the "VP Local Laser Printing" software application package, which, together with the Xerox "4045" or other Laser Copier/Printer, the "6085" "Professional Computer System" using Xerox Corporation "ViewPoint" or "GiobalView®" software and a "local printer [print service]Option" kit, comprises the "Documenter" system. The even earlier Xerox Corporation "8000" "Xerox Network Services Product Descriptions" further describe other earlier Xerox Corporation electronic document printing systems. Eastman Kodak "LionHeart™" systems, first announced Sep. 13, 1990, are also noted. Current popular commercial "systems software" including LAN workstation connections is available from Novell®, Microsoft Windows™, and IBM OS/2.

As shown in the above-cited art, the control of exemplary sheet handling systems in copiers and printers may be accomplished by conventionally actuating them by signals from the copier controller directly or indirectly in response to simple programmed commands and from selected actuation or non-actuation of conventional switch inputs by the operator, such as switches selecting the number of copies to be made in that run, selecting simplex or duplex copying, selecting whether the documents are simplex or duplex, selecting a copy sheet supply tray, etc.. The resultant controller signals may conventionally actuate various conventional electrical solenoid or cam-controlled sheet deflector fingers, motors or clutches in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of document and copy sheets as they are fed and circulated, keeping track of their general positions, counting the number of completed document set circulations and completed copies, etc. and thereby controlling the operation of the document and copy sheet feeders and inverters, etc..

In the description herein the term "sheet" refers to a usually flimsy physical sheet of paper, plastic, or other suitable physical substrate for images, whether precut or web fed. A "copy sheet" may be abbreviated as a "copy", or called "hardcopy". A "job" is normally a set of related sheets, usually a collated copy set copied from a set of original document sheets or electronic document page images, from a particular user, or otherwise related. A "simplex" document or copy sheet is one having its image and page number on only one side or face of the sheet, whereas a "duplex" document or copy sheet has "pages", and normally images, on both sides, i.e., each duplex document and copy is considered to have two opposing sides, faces, or "pages" even though no physical page number may be present.

As to specific components of the subject apparatus, or alternatives therefore, it will be appreciated that, as is normally the case, some such specific components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Figure 10A:
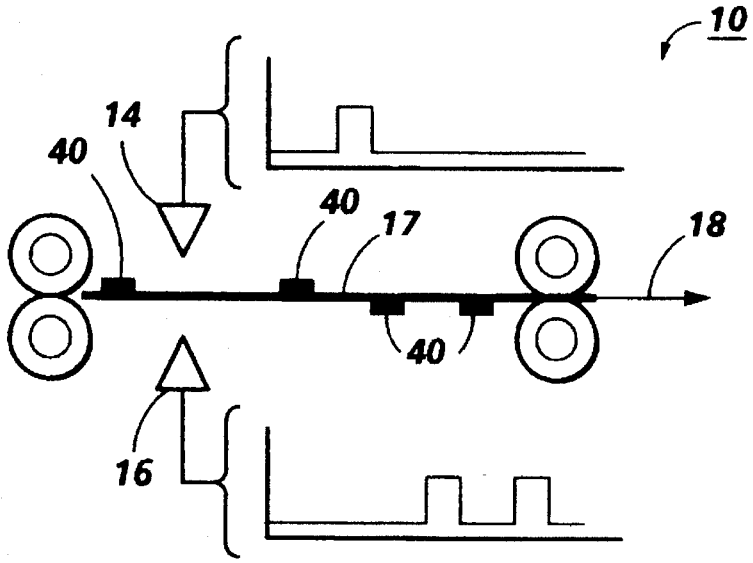
Figure 10B:
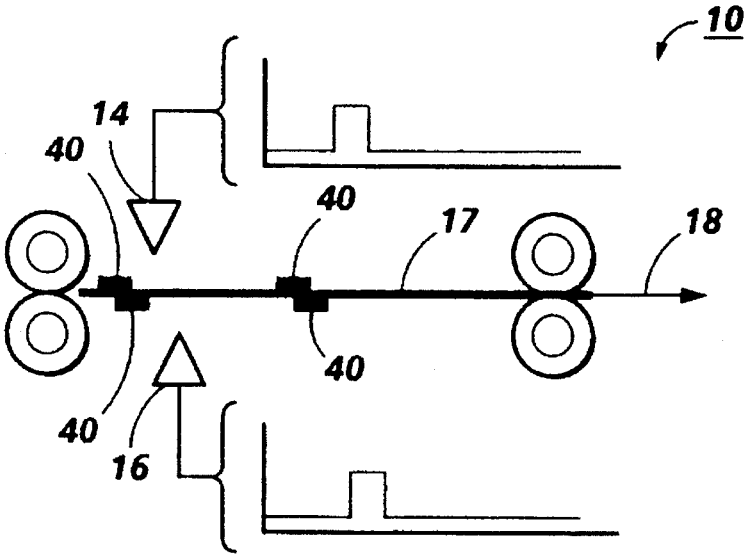

Various of the above-mentioned and further features and advantages will be apparent from the specific apparatus and its operation described in the example(s) below, as well as the claims. Thus, the present invention will be better understood from this description of the embodiment thereof, including the drawing figures (approximately to scale) wherein:

FIG. 1 shows one example of a schematic duplex printer with one example of the subject duplex printing integrity system, including two mark detection sensors in the printer output path and an exemplary block diagram of the connecting circuitry with an exemplary duplexing error signal output connecting to the schematic printer controller and display in this example;

FIGS. 2–5 respectively sequentially show one example of the sequential sheets in the duplexing path of a duplex printer of FIG. 1, or otherwise, at any one time (for a 4 sheet duplex loop example), with exemplary mark indicia in discrete spacing in a linearly readable array in the sheet feeding direction along one sheet margin, so as to be read by one of the mark detection sensors of FIGS. 1 or 10, with phantom line boxes shown for illustration clarity of unprinted spaces between printed marks;

FIGS. 6–9 similarly show the respective correct page order printed second (opposite) sides of the sheets of FIGS. 2–5, each showing similar mating or corresponding exemplary discrete marking indicia thereon obverse mating with or spatially corresponding to the marking spacing of said first side so as to provide a matching sensor output from the opposite side mark detection sensors of FIG. 1 indicative of error free duplexing; and FIGS. 10A and 10B are both an enlarged sheet output path portion of FIG. 1 (a schematic front edge view), of exemplary duplex sheets marked on both sides with, in 10A, a non-corresponding (unmatched) mark pattern to indicate improper duplex page matching, and, in 10B, matching mark patterns on opposite sides of the sheet, and also with the patterns slightly offset, and passing slightly offset top and bottom sensors. The marks in FIG. 10 are given exaggerated thickness for illustrative purposes.

Referring further to the examples shown in the Figures, as noted, FIG. 1 shows one example 10 of the subject duplex printing integrity system installed in one example 12 of a duplex printer having an exemplary known duplexing loop path 13. The duplex printing integrity system 10 here includes two simple reflective optical sensors 14 and 16 respectively mounted above and below the printer output path 18 to line-scan each duplex printed sheet 17. Each sheet 17 is conventionally moving unidirectionally in the conventional printer output path 18 past these sensors. The sensor 14 and 16 outputs here are shown connecting into an exemplary block diagram example of suitable simple connecting circuitry, here comprising a simple comparison circuit 20. In this example, the comparison circuit 20 has an exemplary output 22 for signaling a duplexing error which is connecting with the schematic conventional existing printer controller 100 and display 32 in this example.

In this example of the system 10, duplexing integrity is provided in coordination with the above by one or more simple and relatively small printed dark areas 40, preferably only on the sheets 17 being duplexed, and preferably only when security duplex printing is selected by the operator, such as by a touch screen or other switch 34 on the operator display 32 connecting with the printer controller 100. In this example, the printed indicia for this function is solely the illustrated simple small solid area printed black boxes 40. Only one or two such small boxes 40 need be additionally printed by the printer 12 on both sides of the sheets 17, which are otherwise being normally duplex printed. One example is shown in FIGS. 2–8, as noted above. One or more of such boxes 40 are desirably variably spaced only along one edge margin of both the front (FIGS. 2–5) and back (FIGS. 6–8) of the duplex sheets 17 (sheets 17*a*, 17*b*, 17*c* and 17*d*, in this example of a four sheet length duplex path), to provide an effective duplex page number printing error checking indicia, as will be described. The simple single marks 40 can be easily automatically generated in the printer, which has the sequence of page numbers to be duplex printed already determined in the controller 100, as discussed in the above cited patents thereon. The marks 40 with their selected print locations may be printed by a simple font generation system from the known page numbers. Font generation is well known and widely commercially available. Some font generation examples are noted in Xerox Corporation U.S. Pat. No. 5,167,013 issued Nov. 24, 1992 to R. Hube, et al; U.S. Pat. No. 5,291,243 issued Mar. 1, 1994, and other art noted therein. It may even be possible to use or employ some existing available such printer fonts, such as one or more bold print reasonably large point Roman numeral "I"s or thick solid (not hollow) print capital I's, rather than square or rectangular dark boxes 40 as shown, although such boxes have some described advantages. In any case, the marks 40 are all simply printed in (along) the same line, preferably in a non-image bearing margin area of the sheet, such as along the bottoms of the pages as shown. The marks 40 may desirably be printed widely spaced apart, as shown.

The pattern of marks 40 on each sheet need not be the actual page number, merely the number or correct sequential position of that page in the duplex loop or path at that time, and the same pattern is printed on the opposite sides of each sheet, and thus the same marking indicia pattern can be reused after every 4 sheets in this example of a 4 sheet duplex path length. This reduced number of required discrete or distinguishable patterns of marks 40 per sheet allows even simpler and less critically spaced and thus less critically printed and less critically readable marks, as further discussed below. Longer duplex paths, especially where an intermediate duplex stacking tray is used, in a copier, would of course require more discrete patterns of marks 40.

As each page (each duplex sheet side) is printed, for each set of sheets 17 to occupy the duplex path at one time one or more marks 40 are printed in discrete or unique marking locations, unique to each sheet, linearly along one line location thereof. These simple printed solid marks 40 all line up when printed correctly, so as to provide a simple distinguishable sequence of signals when read by simple stationary optical sensors 14 and 16 in the output path 18, as shown in FIG. 1 and FIG. 10. This is used to insure correct page order duplex output, as will be further explained. All such marks 40 on one side of the paper sheet 17 consistently lie on a line which is parallel to the movement direction of the paper, i.e., the paper path direction of the copy sheet 17 through that part of the printing engine 12 in which the sensors are located. This is so that one simple fixed reflective optical sensor 14 or 16 looking at only one line in a sequence of sheets 17 can pick up all of the marks 40 printed along one edge of that side of the sheet when that sheet goes by that one sensor.

Note that the sensors 14 and 16 here are both well downstream of the duplex path 13, the printing or image transfer station, and the image fusing station, and scan the sheets 17 for duplexing error only after the printing and fusing of both sides of all the sheets has been completed, i.e., downstream of almost all of the potential sheet error or jam sites of the printer 12, so that duplexing errors occurring downstream of the sensors 14 and 16 here would appear to be impossible.

For example, FIGS. 2–9 and 10B show on both sides of the same sheets 17 an equal number of similarly spaced marks 40 in line with the direction of paper travel, which is left to right as shown. The marks 40 on the top side of the sheet 17 pass under top sensor 14 in the output path 18. The similarly spaced side two marks 40 of the exemplary sheets, also on a line parallel to the direction of sheet travel, pass by the side two fixed reflective sensor 16 in the output path 18. The side one line of marks and the side two line of marks are thus parallel, but not necessarily directly on top of one another. The marks and/or the sensors may be offset laterally and/or offset in the process direction as shown in FIG. 10B.

Note that in typical duplex printing most copy sheets are fed sideways or long edge first through the printer paper path, and the sheets being duplexed are lead to trail edge reversed in the duplex path as well as turned over before their second side printing. Thus, to provide matching or overlapping positions of marks on opposite sides of the sheet, they will preferably be printed spaced from the lead edge of the sheet on one side of the sheet and from the trail edge of the sheet on the other side. This may be seen by comparing the exemplary sheets 17*a*–17*d* in FIGS. 6–9 with the same respective sheets in FIGS. 2–5. It should also be noted that either the odd or the even page sides may be printed first or second, i.e., before or after the duplex path loop, depending on the particular printing system and/or the desired sheet output orientation, face up or face down, and/or any sheet inversion in the output or any connecting finisher.

As shown in FIG. 1, with such correspondingly numbered and spaced overlaid front and back side mark 40 patterns, a simple comparison circuit 20, such as a conventional standard logic "exclusive OR gate" as shown, can be used to simply compare the respective sequential signals from the top and bottom of sheet sensors 14 and 16. If the correct pages are being duplexed, their top and bottom mark patterns will correspond, and thus both sensors will be triggered by a corresponding mark 40 at approximately the same time as the corresponding marks on each side of the same sheet pass the two sensors, as shown by the illustrated signals in FIG. 10B. The signal comparator 20 thus simply needs to see if the two sensors are giving the same signals (or absence of signals) at approximately the same times, to determine a match or mismatch. Only if there is a sustained difference between the outputs of the two sensors for that sheet at any time is a duplexing error signal generated by the comparison circuit 20.

To desirably further reduce critically in the size, spacing, position or other such variations of the marks 40, the comparison circuit 20 (internally or connecting with its output) preferably includes well known simple capacitive or feedback integration or binarization thresholding, or other such known filtering. Such filtering prevents a duplexing error signal output unless the requisite "exclusive or" gate input mismatch (the presence of one input signal plus the absence of the other input signal) is sustained for a substantial preset time period. This filter time period should be long enough to filter out brief or transitional input mismatches, and variations in mark size, spacing or position on either side of the sheet, and kept shorter than the minimum mark spacing to prevent inaccurate reading of the next mark. Thus the comparison circuit 20, and thus the overall system 10, is desirably not responsive to brief or transitional input mismatches from even rather gross mark 40 variations in size, spacing or position on either side of the sheet. It also makes this overall system quite immune to transients or noise pulses. This could not be done with bar codes or other fine patterns which produce much more rapid on and off sensor output signals, and thus cannot be so heavily filtered, and thus are much more critical in printing accuracy in line sizes and their relative spacing, as is well known.

This duplexing error or top and bottom of sheet page mismatch signal from the continuous sensor output comparison at circuit 20 can be used for various different operator signal display and/or control functions, and/or an automatic or manual printer duplex path purging and reprinting cycle or shutdown. Some examples of printer sheet purging and job recovery systems with which this system may be combined are described or cited in U.S. Pat. No. 5,045,881 (D/90347). As shown in the FIG. 1 example here, the comparison circuit 20 output 22 indicating a duplexing error may be connected to the schematic printer controller 100 as well as the operator display 32, and that can initiate such functions. This disclosed system 10 allows ample time after sensing a duplex document with mismatched front and back side images for that misprinted sheet, and any other adjacent sheets which need to be purged, to be diverted by an automatically actuated purge gate such as 50 to a purge tray 52 as shown in FIG. 1, and for another sheet or set of sheets to be correctly reprinted. This job correction can be automatic and transparent to the operator. Thus, it does not necessarily require a shutdown and restart of the printer as suggested in the above-cited art. The duplexing error detection signals may also be stored and/or remotely transmitted for diagnostic and servicing information.

Simple time delay circuits 36 and/or 38 can be optionally additionally provided, as shown in FIG. 1, between one or both of the sensor outputs and the comparison circuit 20. That can allow the sensors 14 and 16, and/or the marks 40 on opposite sides of the sheets, to be staggered or offset in the process or sheet feeding direction, yet still provide substantially simultaneous or time overlapping signals to the comparison circuit 20.

This simple and stand-alone or self sufficient duplexing error detection system 10 does not need to receive information from the print engine telling which sheet was expected at any given time. Thus, it does not require a communication link between the printer processor and this detection system, and consequent major software changes. The present system may thus be a simple add-on or modular insert into existing or new printers with little if any interference with the rest of the machine.

The top to bottom height of the mark 40 need only be sufficient to ensure that it will be picked up by the sensor under all tolerance conditions, e.g., any errors in edge registration of the sheet in the paper path at that point. The width or process movement direction dimension of the mark 40 can be quite small, simply enough to provide a clear sensor signal of sufficient duration or pulse width. However, a wider mark can desirably provide more timing latitude for the two sensors signals to overlap, and thus less critically in mark printing positions.

The marks can all be relatively unobtrusive, and need not occupy or require more the normal blank or unimaged page margin area of, e.g, less than 2 cm, as is normally provided along the bottom or top of most document pages anyway. The marks 40 shown in the drawings here are enlarged for illustrative clarity. Other shapes of marks can be used. As noted, only a normal unprinted edge margin area or space along the document is needed for all the marks 40. The small black boxes 40 are not as distractive as a bar code image. No special paper is required. As one example, the marks 40 may be substantially less than 20 mm by 20 mm, preferably less than 1 cm, and the sensors therefor may be a standard issue reflective type sensor such a model 130E05340. There are a variety of other suitable optical sensors available. The boxes 40 can be made even smaller if a finer sensor is used.

For an edge registered rather than center registered printer paper path system, as is common, the marks 40 will preferably be printed on the sheet edge which will be fed adjacent that registration edge (the inboard or outboard sheet edge) after second side printing. Thus, neither the sensors nor the marks need be repositioned for different sizes of sheets.

As noted, the mark locations need only be varied enough in position and/or number to distinguish between the several sheets in the duplex path. That can be up to four sheets in a Xerox Corp. 4850 or 4890 printer product duplex path loop, or up to 7 in a Xerox Corp. duplex option (813) 9700 printer, etc.. That is, only the limited number of sheets in the duplex path at any one time need be differently marked, so only those few different mark positions are needed for a duplex printer without a multiple sheet duplex buffer stacking tray. Thus, the mark positions may be quite uncritical, and allow much wider printing accuracy latitude, as well as large registration and reading error tolerances, especially as compared to a bar code pattern and bar code reader. E.g., simple circuitry can allow up to 10 mm variation of the mark boxes positions yet still achieve a comparison match, and this function can be adjustable. Note that even with five mark positions, and only a maximum of two marks per side, there are 15 possible combinations. Increasing the number of mark positions and the number of marks per side will yield many more combinations.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a duplex printing integrity system for insuring that correctly matching pages are being printed by a duplex printer on the opposing first and second sides of the printed duplex document sheets, wherein said duplex printer has a duplex loop path for circulating sheets printed on one side back to be printed on their opposite side, and an output path for feeding out the duplex document sheets after they have been printed on both sides, said printer being operable to selectively print marks on selectable areas of said duplex document sheets, the improvement comprising:

a first optical sensor positioned in said output path of said duplex printer positioned to line scan said first sides of said printed duplex document sheets as said printed duplex document sheets are fed past said first optical sensor;

a second optical sensor positioned in said output path of said duplex printer positioned to line scan said second sides of said printed duplex document sheets as said printed duplex document sheets are fed past said first optical sensor; and said opposing first and second sides of a sequence of respective said printed duplex document sheets being printed with correspondingly spaced and parallel said print marks, but with different spacings of said marks on said sheets for different said sheets in said sequence.

2. The duplex printing integrity system of claim 1, including a comparison circuit, and wherein said first and second optical sensors provide respective output signals which are electronically connected to said comparison circuit, to provide a duplex printing error signal when said first and second optical sensors provide different said output signals at different times to said comparison circuit responsive to a duplex document sheet passing said sensors which is not so printed on said opposing sides with said correspondingly spaced print marks.

3. The duplex printing integrity system of claim 2, wherein a time delay circuit is connected between at least one of said first and second optical sensors and said comparison circuit to allow said first and second optical sensors and said print marks to be offset from one another.

4. The duplex printing integrity system of claim 1, wherein said print marks are simple small solid areas.

5. The duplex printing integrity system of claim 1, wherein said print marks are all positioned in one edge margin of said duplex document sheets.

6. The duplex printing integrity system of claim 1, wherein said print marks are not more than three simple discrete small solid areas variably linearly positioned substantially spaced part from one another and printed only in an otherwise substantially unprinted top or bottom edge margin of each of said duplex document sheets.

7. The duplex printing integrity system of claim 1, wherein the number of said sheets with said differently spaced said print marks in said sequence corresponds to the number of said sheets in said duplex loop path of said printer at any one time.

8. The duplex printing integrity system of claim 7, wherein said number of sheets with said differently spaced print marks at one time is not greater than 7, and the number of said print marks per sheet side is not greater than two.

* * * * *